United States Patent [19]

Müller et al.

[11] 4,355,618

[45] Oct. 26, 1982

[54] METHOD AND APPARATUS FOR OBTAINING A CONTROL VARIABLE FOR THE CLOSED-LOOP CONTROL OF THE FUEL-AIR RATIO IN THE OPERATING MIXTURE OF INTERNAL COMBUSTION ENGINES

[75] Inventors: Klaus Müller, Tamm; Franz Rieger, Aalen-Wasseralfingen; Helmut Maurer, Schwieberdingen; Ernst Linder, Mühlacker; Harald Reber; Hermann Dietz, both of Gerlingen, all of Fed. Rep. of Germany

[73] Assignee: Robert Bosch GmbH, Stuttgart, Fed. Rep. of Germany

[21] Appl. No.: 207,560

[22] Filed: Nov. 17, 1980

[30] Foreign Application Priority Data

Nov. 17, 1979 [DE] Fed. Rep. of Germany ..... 2946440

[51] Int. Cl.[3] ..... F02B 3/00

[52] U.S. Cl. ..... 123/489; 123/440; 204/195 S

[58] Field of Search ..... 123/489, 440; 204/195 S, 195 T, 1 S, 1 T

[56] References Cited

U.S. PATENT DOCUMENTS

| | | | |
|---|---|---|---|
| 3,860,498 | 1/1975 | Jones | 204/195 S |
| 4,005,689 | 2/1977 | Barnard | 204/195 S |
| 4,061,117 | 12/1977 | Ikeura | 204/195 S |
| 4,088,095 | 5/1978 | Aono | 123/440 |
| 4,178,883 | 12/1979 | Herth | 123/489 |
| 4,237,829 | 12/1980 | Asano et al. | 123/489 |
| 4,237,839 | 12/1980 | Ueno et al. | 123/489 |

*Primary Examiner*—P. S. Lall

*Attorney, Agent, or Firm*—Edwin E. Greigg

[57] ABSTRACT

A method and apparatus is proposed for obtaining a control variable for the closed-loop control of the fuel-air ratio of the operating mixture of internal combustion engines, in which a threshold-current sensor of known structure is used. By means of varying the measurement voltage present at the threshold-current sensor by voltage amounts which correspond to a change in oxygen concentration to be expected in association with a change in operational state, the time behavior of the threshold-current sensor, which is essentially sluggish, is compensated for and it becomes possible to use it for rapidly-functioning closed-loop control systems in internal combustion engines.

5 Claims, 3 Drawing Figures

METHOD AND APPARATUS FOR OBTAINING A CONTROL VARIABLE FOR THE CLOSED-LOOP CONTROL OF THE FUEL-AIR RATIO IN THE OPERATING MIXTURE OF INTERNAL COMBUSTION ENGINES

BACKGROUND OF THE INVENTION

The invention relates to a method and apparatus for obtaining a control variable for the closed-loop control of the fuel-air ratio of the operating mixture in internal combustion engines utilizing an exhaust gas measuring sensor exposed to the exhaust gas flow. The sensor has a body made of fixed electrolyte material which conducts oxygen ions and furnishes a control signal corresponding to the oxygen content in the exhaust gas. The control signal affects a control device which adjusts the fuel-air ratio.

It is known to control the fuel-air composition of the operating mixture in internal combustion engines, holding it to a predetermined air ratio $\lambda$, in a closed-loop manner, with the aid of an exhaust gas oxygen-measuring sensor. The oxygen-measuring sensor employs a body made of fixed electrolyte material which conducts oxygen ions and furnishes a control signal corresponding to the oxygen content. The sensor responds to the partial pressure of the oxygen in the exhaust gas of the engine and generates an output signal, for instance, which has a voltage jump at the air number $\lambda=1$. Such sensors are not well suited to controlling the operating mixture composition to an air number greater than 1, because their output signal varies in linear fashion in accordance with the temperature but only in logarithmic fashion in accordance with the partial pressure of the oxygen in the measured gas. The signal of this sensor is suitable for such closed-loop control only at the stoichiometric point, of the air number $\lambda=1$, where the partial pressure of the oxygen changes by several powers of 10.

Measuring the oxygen in the exhaust gas with a modified oxygen sensor of the type discussed above is also known (See, for example, German laid open application 19 54 663 corresponding to British Pat. No. 1,250,259). Here, a measurement voltage is applied to the electrodes of a sensor of this kind, by means of which a measurement current is generated on the basis of an oxygen ion flow through the fixed electrolyte body of the sensor. The intensity of the measurement current is limited by the diffusion speed of the oxygen and is dependent on the concentration of the oxygen in the gas to be measured. Voltage deviations of the measurement voltage within a predetermined range thus have no effect, in the case of stationary operation, on the current flow, which maintains a current value limited by the diffusion speed (threshold-current sensor).

However, in the transitional range, this threshold-current sensor has the disadvantage that when there is an abrupt change in the oxygen concentration the current approaches the new threshold-current value corresponding to the altered concentration exponentially. The sensor thus reacts somewhat sluggishly to changes in concentration, and is thus less well suited for use in rapidly responding control means.

OBJECT, SUMMARY AND ADVANTAGES OF THE INVENTION

It is an object of the invention to improve the control of the fuel-air composition of the operating mixture of an internal combustion engine by improving the operation of the rapid-functioning closed-loop control system used to effect the noted control.

This object is achieved by providing the closed-loop control with a control variable obtained according to a method and apparatus which utilizes a threshold-current sensor of known structure. The time behavior of the threshold-current sensor is compensated for so that it can be used to obtain the control variable. The measurement voltage at the threshold-current sensor is varied in order to correspond to the expected change in the oxygen concentration of the exhaust due to a changed operating state of the engine. The threshold-current sensor is thus adapted for its intended purpose of obtaining the control variable.

The method and apparatus according to the invention has the following advantage: By making a change in the measurement voltage—a change which corresponds to the disturbance variable (change in oxygen concentration, for instance occasioned by a change of engine operational state) and may be, for instance, an increase in the measurement voltage—a supplementary current is generated at the threshold-current sensor; this supplementary current fades in approximately exponential fashion and, added with the current deriving from the increase in oxygen concentration, causes an abrupt change of signal to a threshold-current value corresponding to the new oxygen concentration. The response speed of the threshold-current sensor is thus substantially increased, so that it can be used in rapid-functioning closed-loop control systems.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
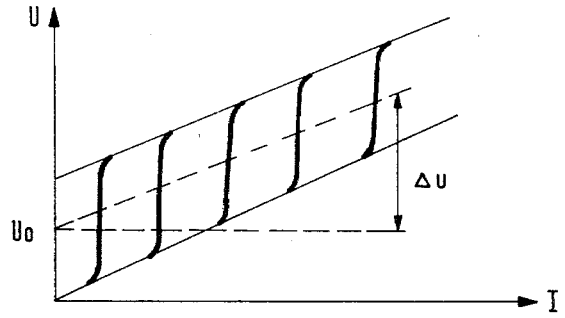
FIG. 1 is a schematic illustration of the characteristic curve pattern of a threshold-current sensor for various oxygen contents in the exhaust gas.

In the solution according to the invention, a so-called threshold-current sensor is used, such as that described in British Pat. No. 1,250,259 or laid-open German application 27 11 880 corresponding to U.S. application Ser. No. 213,049. Sensors of this type have an ion-conducting fixed electrolyte located between two electrodes, with the two electrodes being permeable to gas and exposed to a measurement voltage. Depending on the oxygen content in the gas to be measured, a greater or lesser diffusion threshold current is established which, as its name suggests, is restricted by the diffusion speed of the oxygen molecules arriving at one of the electrodes. Sensors of this type have a characteristic curve performance graph, given various oxygen contents in the exhaust gas, of the type shown in FIG. 1. There, the current (I) measured at the threshold-current sensor is shown in relationship to the voltage (U) applied to the sensor. It can be seen that at each oxygen concentration the measured current remains constant between a predetermined range of measurement voltage change. Because of this property of such sensors, it is also possible to use the output of the threshold-current sensor for closed-loop control of the fuel air composition of the operating mixture in internal combustion engines. The constant threshold current level, extending over a relatively large measurement voltage difference, makes the control signal of the threshold-current sensor essentially independent of any disturbing influences.

The dynamics of the threshold-current sensor are determined, as noted above, by diffusion processes. However, given an abrupt change in oxygen concentration, the threshold-current sensor reacts only in a delayed fashion, with a transfer behavior which can be represented, in the Laplace-transform retangular boundary by the equations:

$$I(p)=G_P(p).P_{O2}(p),$$

$$G_P(p)=K/(l+T_p p).$$

In these equations, the complex variable p corresponds with the time t, I is the threshold current, K is a constant, $T_p$ is the time constant and $P_{O2}$ is the oxygen concentration. For the purposes of rapidly-functioning closed-loop control, an abrupt reaction on the part of the output signal of the threshold sensor is desired when there is an abrupt change in the oxygen concentration. This would correspond to a transfer behavior of:

$$G_P(p)=K$$

It has been found that the current signal of the threshold-current sensor varies in the threshold-current range, given a change in the supply voltage, by an amount $\Delta U$, in complementary fashion to the behavior described above. The change in the threshold current then is effected according to the transfer equation:

$$G_U(p)=K_U \cdot T_U \cdot p/(l+T_U \cdot p)$$

Figure 2:
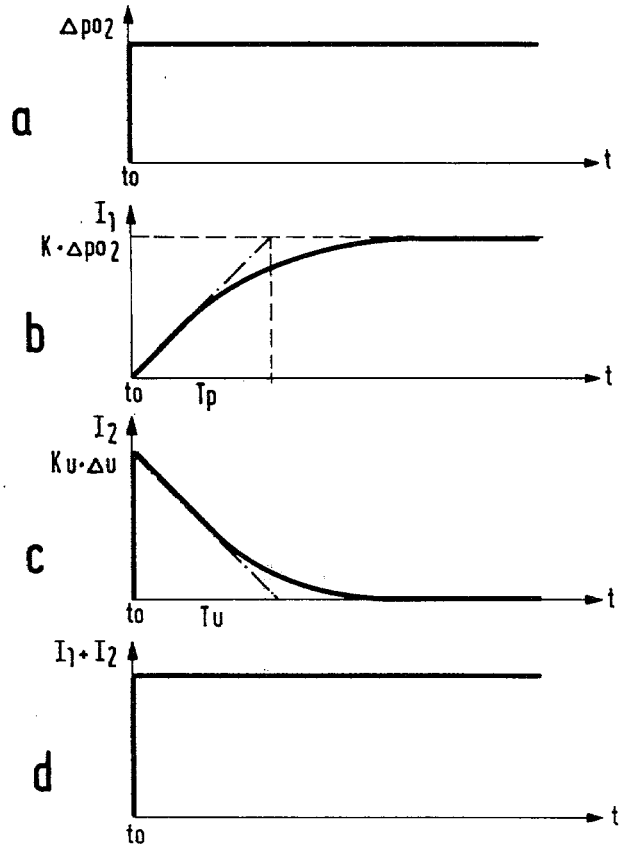
FIGS. 2*a* through 2*d* show the signal formation according to the method of the invention given an abrupt change in the oxygen content in the exhaust gas.

Now if simultaneously with the increase in the oxygen content the measurement voltage is also increased by a predetermined amount $\Delta U$, then this causes a compensation for the time behavior of the threshold-current sensor described above when there is a change in oxygen concentration. This is illustrated by FIGS. 2*a* through 2*d*. FIG. 2*a* shows how the oxygen content varies abruptly by an amount of $\Delta P_{O2}$ at time $t_o$. FIG. 2*b* shows how the threshold current normally increases from a first level at time $t_o$ to a second level $K \cdot \Delta P_{O2}$. In fact, it does so with a time constant $T_p$. If the measurement voltage is increased by a value corresponding to the change in oxygen content, then the result is a supplementary current through the threshold-current sensor in accordance with the curve path shown in FIG. 2*c*. It can be seen that the current gradually drops from a value of $K_U \cdot \Delta U$ at time $t_o$ to a value of zero. The time constant $T_U$ which pertains to this process approximately corresponds to the time constant $T_p$ of the current profile shown in FIG. 2*b*. In like manner, the value K in FIG. 2*c* is approximately equal to the value $K_U$ in FIG. 2*b*. FIG. 2*d* illustrates how, as a result of the addition of both currents, an abrupt increase in the threshold current occurs at time $t_o$ corresponding to the abrupt increase in the oxygen concentration. The time constant $T_U$ is determined by the electrical properties of the threshold-current sensor. By appropriate means for varying the capacity of the capacitor characteristic of the threshold-current sensor, an adaptation of the time constant $T_U$ to the time constant $T_p$ can be attained. In a corresponding manner, the variation in measurement voltage $\Delta U$ must also be adapted to a predetermined oxygen concentration in such a fashion that for both curve paths, the value $K_U \cdot \Delta U \simeq K \Delta P_{O2}$ is constant. In order to attain a rapid reaction on the part of the threshold-current sensor, the measurement voltage must be varied, given a change in operational status and a change thus effected in the oxygen concentration, by an amount corresponding to the expected change in oxygen concentration. Because of the characteristic behavior of the threshold-current sensor in the threshold-current range, which is not to react to measurement voltage differences, the above-described control intervention can be made, because the current momentarily produced by the change in the measurement voltage fades again after a short time. For longer periods after time $t_o$, the actual measurement value of the threshold-current sensor accordingly represents a standard value. Thus, coarse adjustments can be made in response to rapidly-occurring changes in the oxygen concentration by means of the method according to the invention, and precise control can be exerted if the changes are of longer duration.

Figure 3:
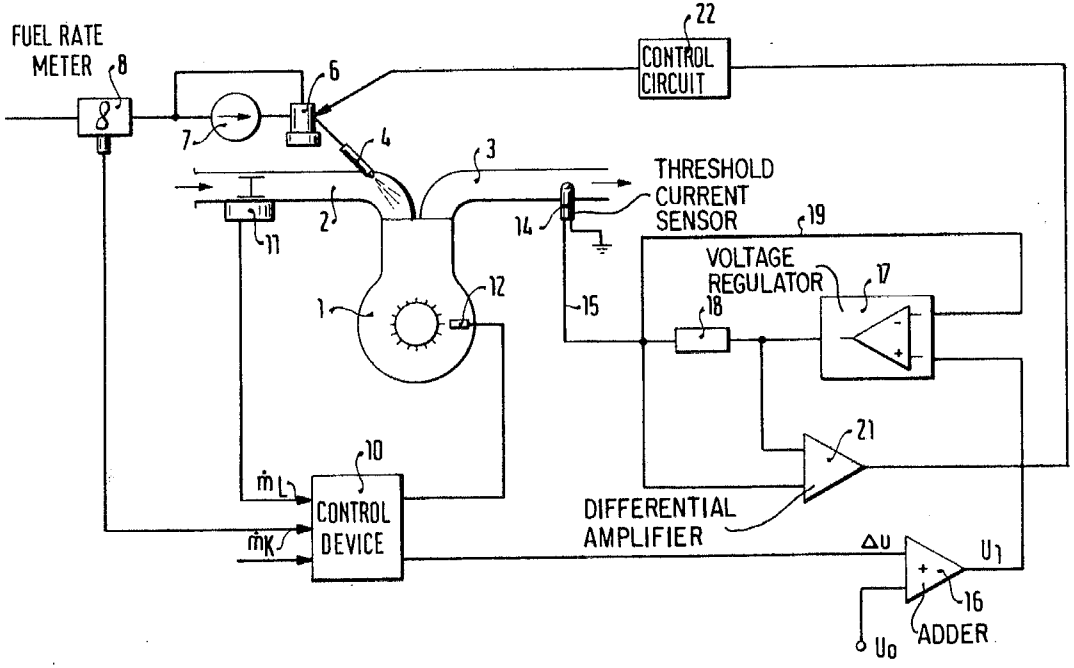
FIG. 3 shows one exemplary apparatus for performing the method according to the invention.

FIG. 3 shows schematically an apparatus for performing the method described above. An internal combustion engine 1 is shown schematically, having an intake manifold system 2 and an exhaust manifold system 3. The supply of fuel to the engine may be effected, for instance, by means of injection into the intake manifold system 2. To this end, as shown, a fuel injection valve 4 is provided upstream of the inlet valve or valves (not shown) of the engine. The injection valve 4 is supplied with fuel from a fuel supply device 6, for instance in accordance with the quantity of aspirated air. The fuel is delivered to the fuel supply device 6 by a pump 7 from a fuel tank. Fuel supply devices of this kind, controlled in open-loop fashion, are known and need not be described further herein.

According to the exemplary embodiment of the invention, the fuel quantity injected via the fuel injection valve 4 is measured with the aid of a fuel rate meter 8, which may be provided on the intake side of the fuel pump 7, for instance. The fuel rate meter 8 furnishes a control signal to a control device 10, which can be furnished, in addition or alternatively, with a control signal from an air flow rate meter 11 provided in the intake tube of the engine. There is also the possibility of delivering an rpm signal from an rpm transducer 12 to the control device 10. In the control device 10, a voltage $\Delta U$ is formed with the aid of the air flow rate signals, fuel rate signals, and/or rpm signals. This voltage corresponds to the estimated lambda value for the operational state of the engine prevailing at the time. The control device 10 may contain stored data in the form of a performance graph, for instance, or characteristic curves on the basis of which the particular voltage $\Delta U$ is furnished in accordance with the corresponding input parameters.

A threshold-current sensor 14 is disposed in the exhaust manifold system 3 and a measurement voltage is applied to this sensor 14 via a supply line 15. The measurement voltage is formed by the addition of the voltage signal $\Delta U$ and a reference measurement voltage $\Delta U_o$. This addition produces the corrected measurement voltage $U_l$, which is present at the output of a device 16 and is delivered to a voltage regulator 17. From the output of the voltage regulator 17, the voltage is carried via a measuring resistor 18 to the threshold-current sensor 14. A feedback line 19 branches off between the measuring resistor 18 and the threshold-current sensor 14 and is connected to the input of the voltage regulator 17. The voltage drop appearing at the measuring resistor 18 on the basis of the current flowing through the threshold-current sensor 14 is measured with the aid of a differential amplifier 21, whose inputs are connected with a pickup before and after the measuring resistor 18. The output of the differential amplifier 21 is connected with a closed-loop control circuit 22, by means of which a correction signal is furnished, for instance to the fuel supply and dispensing device 6.

The voltage regulator 17 in combination with the feedback line 19 assures that the threshold-current sensor 14 is exposed to the voltage $U_l$ independently of the threshold current being established. As may be understood from FIG. 1, the voltage $U_o$ represents the lowest measurement voltage which may be expected. There is thus the advantage that by the addition of the voltage signal $\Delta U$, the average measurement voltage will always lie in the middle range of the linear portion of the relevant current curve, so that even with large changes in the air number $\lambda$, it will be the threshold current corresponding to the relevant oxygen concentration which is detected.

By appropriate embodiment of the control device 10, the estimated lambda value can be formed more or less precisely in the form of the corrective voltage $\Delta U$. In the simplest possible case, a potentiometer controlled in a load-dependent manner will suffice. In self-igniting engines, the air number $\lambda$ approaches the value $\lambda=1$ with increasing load, for example. A potentiometer actuated by the fuel quantity adjustment member of the injection pump can be used here with sufficient precision for the ascertainment of the estimated $\lambda$ value or for forming the control signal $\Delta U$.

The apparatus described can perform retroactive closed-loop control sufficiently rapidly even in the case of large changes in the operational state of the engine or in the oxygen concentration in the exhaust gas. It is not of critical importance whether the current resulting at time $t_o$ according to FIG. *2d* exactly corresponds to the oxygen concentration in the exhaust gas at time $t_o$. What is essential is that at this time, with a given current according to FIG. *2c*, the inertial behavior of the threshold-current sensor 14 is approximately compensated for. After the elapse of the time constants, the sensor is in a position to establish a desired lambda value with a high degree of precision.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for obtaining a control variable for a closed-loop control device for the closed-loop control of the fuel-air ratio of the operating mixture in internal combustion engines utilizing an exhaust gas threshold-current sensor exposed to the exhaust gas flow and a control device for adjusting the fuel-air ratio of the operating mixture, said sensor operating on the principle of oxygen ion conduction when exposed to voltage and having a body made of fixed electrolyte material which conducts oxygen ions and furnishes a control signal corresponding to the oxygen content in the exhaust gas, wherein the threshold current of the sensor, defined by the diffusion speed of the measured gas, is a standard for the oxygen content in the exhaust gas, the method comprising the steps of:

generating a voltage difference signal which corresponds to the change in the air number $\lambda$ of the operating mixture when there is a change in the operational state of the engine;

generating a reference measurement voltage signal;

adding the generated voltage difference signal and the generated reference measurement voltage signal; and applying the added generated voltage difference signal and the generated reference measurement voltage signal to the exhaust gas threshold-current sensor and measuring the resultant current through the exhaust gas threshold-current sensor, said resultant current serving as a standard for the percentage oxygen content in the closed-loop control circuit with the oxygen content which is to be maintained; whereby the closed-loop control device corrects the fuel-air ratio accordingly.

2. An apparatus for obtaining a control variable for a closed-loop control device for the closed-loop control of the fuel-air ratio of the operating mixture in internal combustion engines, comprising:

means for ascertaining the operational state of the engine;

control means connected to the means for ascertaining the operational state of the engine for generating a voltage difference signal corresponding to the change in the air number $\lambda$ resulting from the ascertained change in the operational state of the engine;

an exhaust gas threshold-current sensor exposed to the flow of exhaust gas, said sensor having a fixed electrolyte body which conducts oxygen ions;

means for adding the voltage difference signal to a reference measurement voltage signal and applying the added voltage signals to the exhaust gas threshold-current sensor; and current measuring means for measuring the resultant current through the exhaust gas threshold-current sensor as a result of applying the added voltage signals, whereby the resultant current serves as the control variable for the control device.

3. The apparatus as defined in claim 2, wherein the control means includes a performance graph memory.

4. The apparatus as defined in claim 2, further comprising:

a voltage regulator connected to the exhaust gas threshold-current sensor and the means for adding the voltage difference signal and the reference measurement voltage signal.

5. The apparatus as defined in claim 4, further comprising:

a measuring resistor connected between the voltage regulator and the exhaust gas threshold-current sensor;

a feedback line connected to the input to the voltage regulator and the exhaust gas threshold-current sensor side of the measuring resistor.

* * * * *